US006176310B1

(12) United States Patent
Smith et al.

(10) Patent No.: US 6,176,310 B1
(45) Date of Patent: Jan. 23, 2001

(54) ASSEMBLY FOR SEALING THE ANNULUS BETWEEN CONCENTRIC CYLINDRICAL SURFACES

(75) Inventors: Jerry D. Smith, The Woodlands; Floyd J. Lane, Houston, both of TX (US)

(73) Assignee: ERC Industries, Inc., Houston, TX (US)

( * ) Notice: Under 35 U.S.C. 154(b), the term of this patent shall be extended for 0 days.

(21) Appl. No.: 09/253,664

(22) Filed: Feb. 19, 1999

(51) Int. Cl.[7] ..... E21B 33/128

(52) U.S. Cl. ..... 166/89.1; 166/196; 277/328; 277/337; 277/339

(58) Field of Search ..... 166/89.1, 196, 166/387, 86.1, 88.2, 208; 277/328, 337, 339, 329, 335, 511, 531

(56) References Cited

U.S. PATENT DOCUMENTS

| | | | | |
|---|---|---|---|---|
| 2,205,739 | * | 6/1940 | Wilson | 277/337 X |
| 2,714,932 | * | 8/1955 | Thompson | 277/339 X |
| 4,131,287 | | 12/1978 | Gunderson et al. | 277/191 |
| 4,556,224 | | 12/1985 | Le | 277/118 |
| 4,588,029 | | 5/1986 | Blizzard | 166/120 |
| 4,628,997 | * | 12/1986 | Schraub | 166/196 X |
| 4,646,845 | | 3/1987 | Bocker | 166/387 |
| 4,665,979 | | 5/1987 | Boehm, Jr. | 166/208 |
| 4,742,874 | | 5/1988 | Guillon | 166/348 |
| 4,751,965 | | 6/1988 | Cassity | 166/182 |
| 4,791,992 | * | 12/1988 | Greenlee et al. | 166/196 X |
| 4,823,871 | | 4/1989 | McEver et al. | 166/182 |
| 5,044,672 | | 9/1991 | Skeels et al. | 285/98 |
| 5,110,144 | | 5/1992 | Burton et al. | 277/116.2 |
| 5,325,925 | | 7/1994 | Smith et al. | 166/387 |

* cited by examiner

*Primary Examiner*—H. Shackelford
(74) *Attorney, Agent, or Firm*—Head, Johnson & Kachigian

(57) ABSTRACT

An assembly for sealing the annular space between the inner cylindrical surface of a tubular member and the outer surface of a cylindrical member having a separate upper and lower seal member each of which are sealably and translatably positioned on the cylindrical member outer cylindrical surface, each of the upper and lower seal members having a circumferentially outwardly displaceable sealing lip and including a tubular actuator positioned between the upper and lower seal members having end portions for radially outwardly displacing the upper and lower sealing lips and including a downwardly displaceable seal energizer for moving the upper seal member towards the lower seal member to cause the actuator to concomitantly, radially outwardly expand the circumferential sealing lips.

6 Claims, 4 Drawing Sheets

ASSEMBLY FOR SEALING THE ANNULUS BETWEEN CONCENTRIC CYLINDRICAL SURFACES

REFERENCE TO PENDING APPLICATIONS

This application is not related to any pending United States or international patent application.

REFERENCE TO MICROFICHE APPENDIX

This application is not referenced in any Microfiche Appendix.

BACKGROUND OF THE INVENTION

The customary procedure for drilling an oil and gas well is to anchor a relatively large diameter surface pipe in the earth down through which the bore hole for the well is drilled. A well head is secured to the upper end of the surface pipe. Suspended within the surface pipe and extending down into the bore hole is typically a string of casing pipe and within the casing pipe a string of tubing, the tubing pipe serving as the conduit by which produce liquids and/or gases are conveyed from the producing formation to the earth's surface. A hanger is employed by which the casing string and/or tubing string is suspended from the well head. A sealing system is required to seal the annular space between the interior of the well head and the exterior of the hanger supported within the well head. This invention provides an improved sealing system for this purpose.

Nearly all casing and tubing hanger seals in use today utilize an elastomeric element and elastomeric seals have known limitations. They tend to loose their effectiveness when exposed to heat or to corrosive substances such as hydrocarbons or hydrogen sulphide or to great pressures over a long period of time. The natural aging process of elastomers causes them to harden and become brittle over time and once hardened and brittle they lose their sealing effectiveness and may thereafter permit leakage to occur. In some instances the long exposure of elastomeric seals to high pressures can cause them to flow and creep permitting leakage of gases or liquids to the environment.

In recent years, effort has been made to replace elastomeric tubing or casing hanger seals with more reliable and longer lasting metal to metal seals. The invention described herein is for an improved metal to metal seal to close the annulus between concentric cylindrical surfaces such as the concentric surfaces between the interior cylindrical surface of a well head and the exterior cylindrical surface of a tubing or casing hanger.

For background information of the art to which the present invention relates reference can be made to the following previously issued United States Patents.

| U.S. Pat. No. | INVENTOR | TITLE |
|---|---|---|
| 4,131,287 | Gunderson et al | Annular Seal |
| 4,556,224 | Le | Crossover Seal Assembly |
| 4,588,029 | Blizzard | Expandable Metal Seal for a Well Tool |
| 4,646,845 | Boeker | Metal Seal for Wellhead Apparatus |
| 4,665,979 | Boehm, Jr. | Metal Casing Hanger Seal with Expansion Slots |
| 4,742,874 | Gullion | Subsea Wellhead Seal Assembly |

-continued

| U.S. Pat. No. | INVENTOR | TITLE |
|---|---|---|
| 4,751,965 | Cassity | Wellhead Seal Assembly |
| 4,823,871 | McEver et al | Hanger and Seal Assembly |
| 5,044,672 | Skeels et al | Metal-to-metal Sealing Pipe Swivel Joint |
| 5,110,144 | Burton et al | Casing Hanger Seal Assembly |
| 5,325,925 | Smith et al | Sealing Method and Apparatus for Wellheads |

BRIEF SUMMARY OF THE INVENTION

The invention herein is an assembly for sealing the annulus between concentric cylindrical surfaces. A typical application for the invention and one to which it is particularly adapted is that of sealing the annular space between a well head and a casing hanger or tubing hanger. The hanger external cylindrical surface is defined by spaced apart circumferential portions of increased external diameters in the downward direction providing (a) an upper sealing surface, (b) an intermediate upper sealing surface, (c) an intermediate lower sealing surface and (d) a lower sealing surface. The well head has a test port extending from an exterior surface to its internal cylindrical surface.

The sealing assembly includes tubular upper and lower seal members that are received on hanger cylindrical surface. The upper seal member has an outwardly deflectable circumferential sealing lip, a downwardly extending circumferential inner seal and an upperwardly extending circumferential inner seal. The tubular lower seal member is also received on the external cylindrical surface of the hanger below the upper seal member. The tubular lower seal member has a radially outwardly deflectable circumferential sealing lip, a downwardly extending circumferential inner seal and an upwardly extending circumferential inner seal. Thus the upper and lower seal member together have a total of two outwardly deflectable circumferential sealing lips and four circumferential inner seals.

A tubular actuator is received on the hanger cylindrical surface between the upper and lower seal members.

Completing the sealing assembly is an energizer that is threaded on to the upper end portion of the hanger. When the energizer is downwardly displaced the upper seal member is moved downwardly toward the lower seal member to forcibly downwardly displace the seal members to cause the actuator to radially outwardly deflect the upper and lower circumferential sealing lips against the well head cylindrical surface. The downward displacement of the seal members by the energizer also causes the four inner seals to sealably engage the four hanger sealing surface to thereby seal the annular space while isolating the test port between the intermediate upper and lower sealing surfaces.

Thus the sealing assembly when employed in the specific embodiment as used to seal the annular space between the internal cylindrical surface of a well head and the external cylindrical surface of a hanger function not only to seal this surface against the passage of fluids or gases through the annular area but also provides an intermediate closed annular space between the upper and lower seals that has communication with the test port. By opening the test port a workman can verify that the seal assembly is functioning for its intended purpose of preventing the passage of fluids or gases into or out of the annular area.

The invention will be better understood by reference to the detailed description of the preferred embodiments, taken in conjunction which with the attached drawings.

DETAILED DESCRIPTION OF A PREFERRED EMBODIMENT

The invention herein is an improved seal assembly that can be used to seal an annular area between the internal surface of a tubular member and the external surface of a concentrically positioned cylindrical member irrespective of the specific function of the tubular member or the cylindrical member. However, the invention is particularly applicable and will be specifically described in which it is used to provide an improved assembly for sealing the annulus between the exterior of a hanger, either tubing hanger or casing hanger, positioned within the internal cylindrical surface of a well head.

Figure 1:
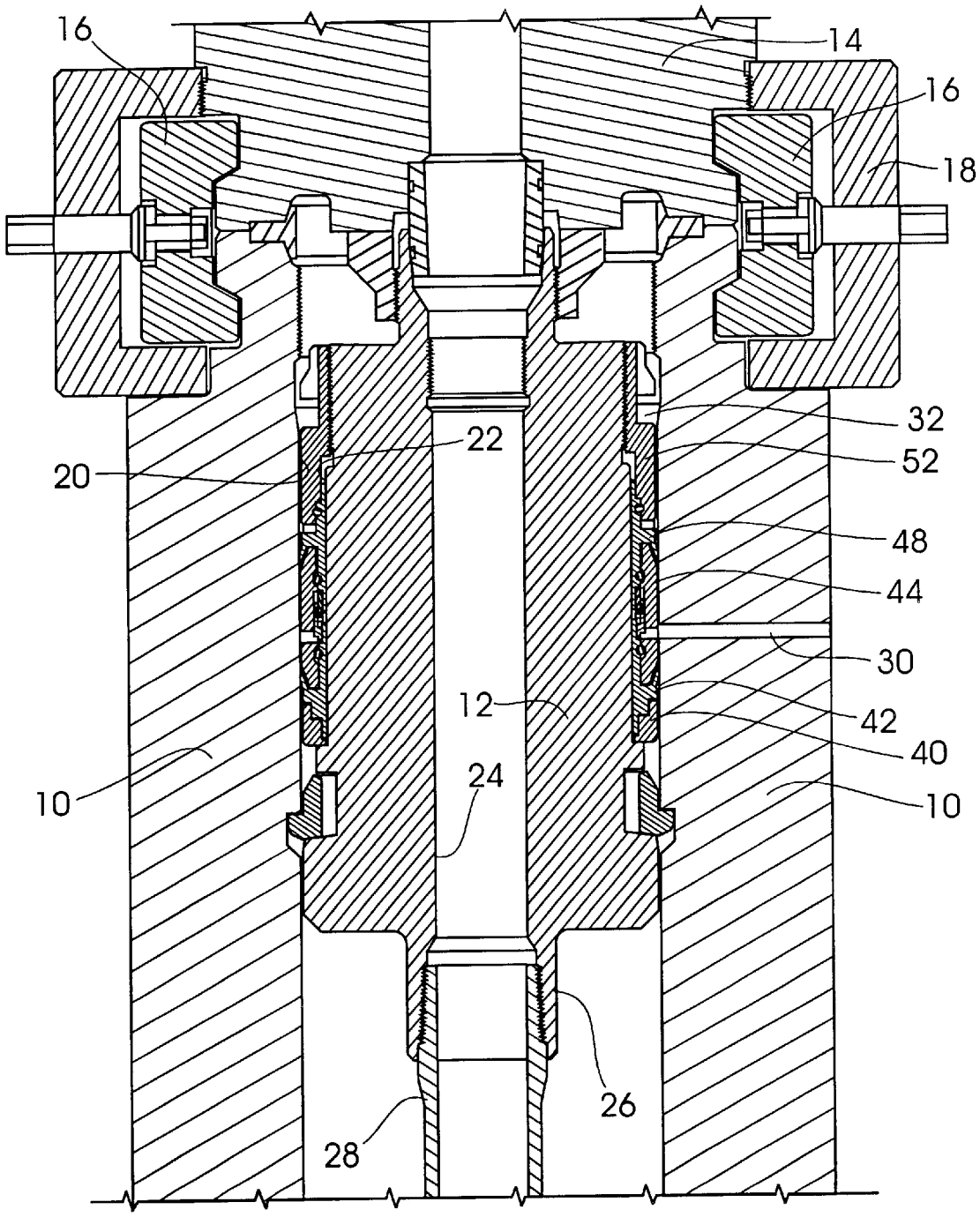
FIG. 1 is an elevational view of a portion of a well head showing in cross-section a tubing hanger positioned in the well head and showing an assembly for sealing the annular area between the exterior of the hanger and the interior of the well head.

FIG. 1 illustrates in elevational cross-section the relevant portions of a well head and a tubing hanger, the well head being indicated by numeral 10 and the tubing hanger by numeral 12. The well head 10 is shown more or less diagrammatically, in that the external shape of a well head can vary considerably and the particular external arrangement of the well head is not relevant to the invention, however, the internal cylindrical surface of the well head is important and will be described in detail. In the same way, the particular configuration of tubing hanger 12 can vary significantly however, the important aspect of the tubing hanger is its external cylindrical surface and this will be described in detail.

Typically, well head 10 is supported at the upper end of surface pipe down through which a well bore hole has been drilled. Well head 10 may be a part of other equipment used for drilling and completing an oil or gas well. Other portions of the well head are not shown since they are well known by practitioners in the art and are not relevant to the invention. In FIG. 1 an attachment device 14 is shown supported to the upper end of well head 10 and held in place by segmented C-shaped members 16 that are retained within an attachment ring 18. Elements 14–18 typically illustrate apparatus attached to the upper portion of a well head 10 but are not part of the invention.

Well head 10 may be termed a "tubular" member in that it has an internal cylindrical surface 20 while tubing hanger 12 may be turned a "cylindrical" member since it has an external cylindrical surface 22 though as seen in the drawings, tubing hanger 12 is also tubular in function since it has an internal passageway 24. The lower end of tubing hanger 12 has an integral internally threaded collar portion 26 configured to receive the threaded attachment of the upper end of a tubing string 28. The specific arrangement of the lower end of tubing hanger 12 and the manner in which a tubing string is attached to it is not a part of this invention as the method of attachment of a tubing string can vary considerably. In some instances a tubing string is supported at the upper end of a tubing hanger.

Extending through the wall of well head 10, that is from the exterior of the well head and communicating with internal cylindrical surface 20 is a test port 30, the function of which will be described subsequently.

An annular area, generally indicated by the numeral 32, is formed between internal cylindrical surface 20 of well head 10 and external cylindrical surface 22 of tubing hanger 12. To prevent the passage of liquids or gases through this annular area, that is past the tubing hanger, it is necessary to provide a sealing system and it this sealing system to which this invention is directed and which will now be described in detail starting with reference to FIG. 2.

Figure 2:
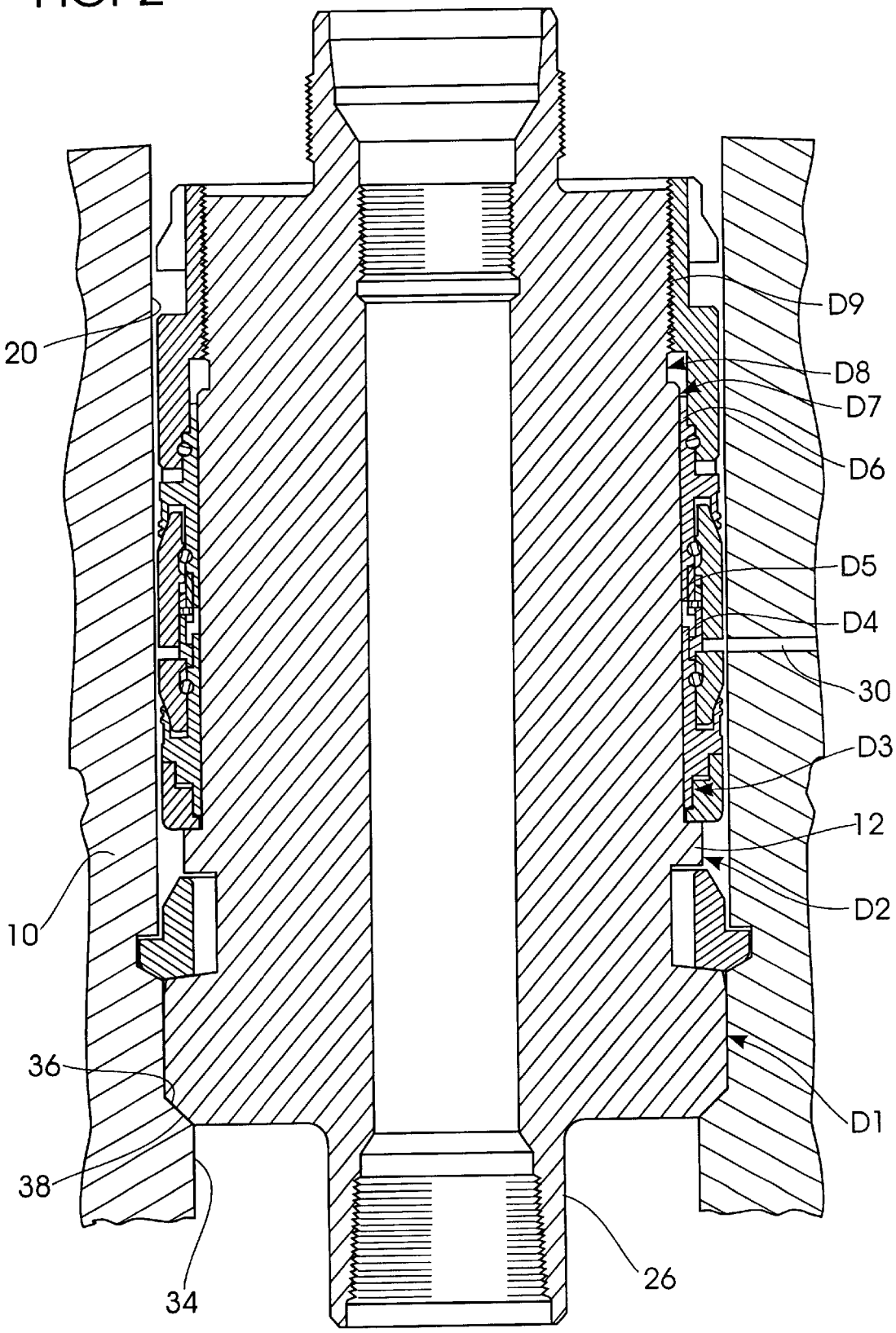
FIG. 2 is an enlarged elevational view of the tubing hanger positioned within the well head with the seal assembly in place and the energizer in an initial position in which the seal assembly has not been set.

FIG. 2 is an enlarged representation of tubing hanger 12 and a fragmentary portion of the well head. Well head 10 has at a lower internal portion thereof a reduced internal diameter cylindrical surface 34 providing a circumferential inclined ledge 36. Adjacent the lower end of tubing hanger 12 is a matching outwardly inclined annular shoulder 38 that seats on ledge 36 by which the tubing hanger is vertically supported in the well head. Instead of a fixed shoulder 38 in some embodiments an annular seating ring may be interposed between ledge 36 and shoulder 38 but the principle remains the same, that is, hanger 12 is removably supported within well head 10 to support a string of pipe which may be either tubing or casing.

This invention is concerned with the method of sealing the annular area 32 between the exterior of the hanger and the interior of the well head, that is, between the internal cylindrical surface 20 of the well head and the external cylindrical surface 22 of the hanger.

FIG. 1 shows the external cylindrical surface of hanger 12 identified by the numeral 22. This is a general designation as the external cylindrical surface that in fact has a plurality of different external diameters each of which is important in the sealing system. FIGS. 3–6 each show an enlarged fragmentary area of the well head and hanger and the sealing assembly in the annular area 32. The hanger external cylindrical surface generally indicated by numeral 22 has nine external diameters as illustrated in FIGS. 4 by indicators D1 through D9. Diameter D1 is greatest and the external diameter diminish in an upward direction towards diameter D9. The diameters that are directly relevant to the application of the seal assembly by which annular area 32 is sealed are diameters D3 through D6. The criticality of these diameters will be described in detail.

Figure 3:
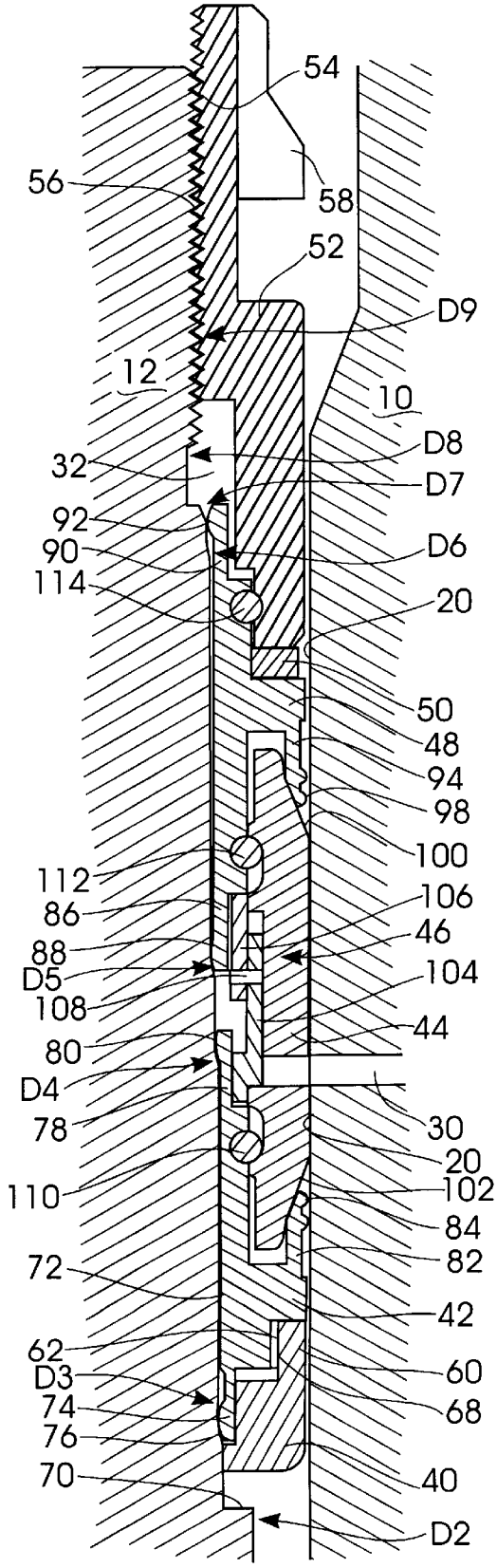
FIG. 3 is an enlarged fragmentary, elevational and cross-sectional view of the right hand portion of FIG. 2.
Figure 4:
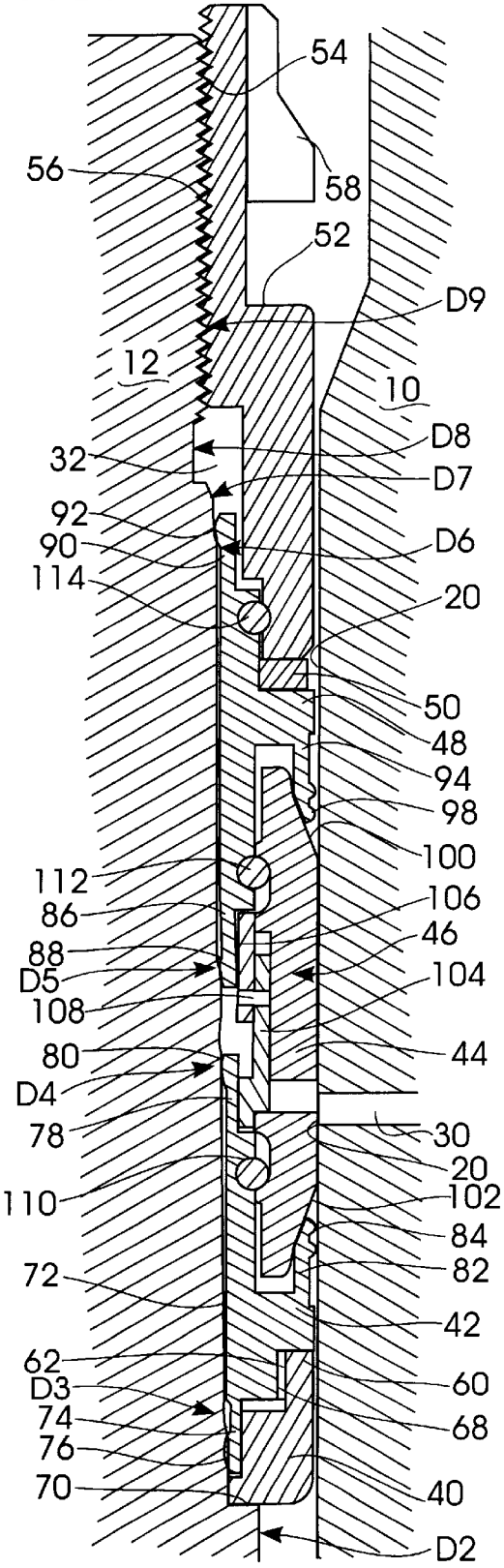
FIG. 4 is an enlarged fragmentary view of the sealing assembly including upper and lower seal members, an intermediate tubular actuator and a seal energizer as the assembly is in position on the exterior of a tubing hanger within a well head and with the energizer moved downwardly to position the lower seal in its sealing position.
Figure 5:
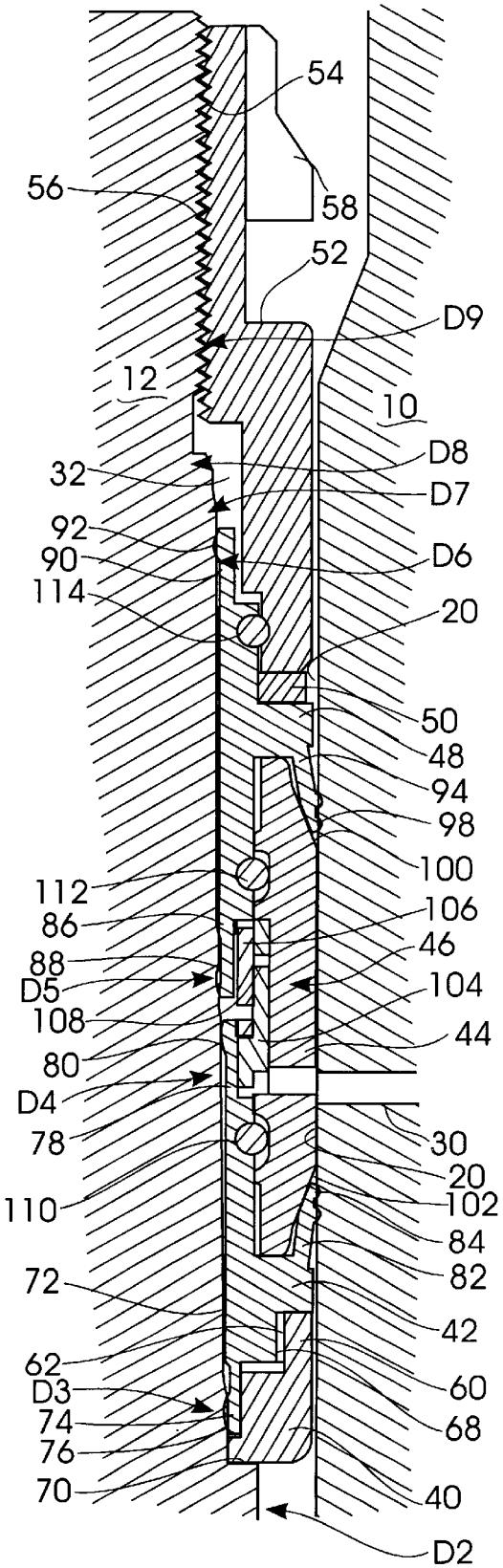
FIG. 5 shows the final step in setting the assembly to provide a metal to metal seal between the exterior surface of the tubing hanger and the internal surface of the well head and showing a test port that communicates with an isolated intermediate sealed portion of the annular area between the tubing hanger and the well head.

The seal assembly consists of these basic components as best seen in FIGS. 3 through 5: a support ring 40, a lower seal member 42, a tubular actuator 44, a telescopically collapsible spacer ring generally indicated by the numeral 46, an upper seal member 48, a bearing ring 50, and a seal energizer 52.

The upper portion of hanger 12 has external threads 54 at a diameter D9 that receive internal threads 56 on the upper portion of seal energizer 52. Spaced apart integral wing portions 58 extend from seal energizer 52 and provide a way to rotate the seal energizer to set the seal assembly in a way that will be described subsequently.

After the hanger 12 is positioned within the well bead, the hanger having a string of tubing or casing extending downwardly from it, annular area 32 between the exterior of the hanger and the interior of the casing must be sealed to prevent passage of fluids or gases from within the well bore hole to the exterior and for this purpose the seal assembly of this invention is employed. The seal assembly which consists of elements 40 through 52 is positioned down over the hanger into annular area 32. Seal energizer 52 is rotatably downwardly advanced to cause sealing action to take place in the sequence illustrated in FIGS. 3–5, FIG. 3 being illustrative of the seal assembly inserted in position but not set.

The seal assembly provides four separate spaced apart circumferential sealing relationships between the exterior diameters of tubing hanger 12 and the two spaced apart seals with interior cylindrical surface 20 of well head 10. Thus, the sealing assembly achieves a total of six circumferential seals in the annular area that are accomplished as energizer 52 is threadably downwardly advanced to the full seal set position.

The elements 40–52 making up the seal assembly will now be described in greater detail starting from the bottom and working upwardly with respect to FIGS. 3–5. Support ring 40 is an annular member having an integral upwardly extending circumferential tubular portion 60 that has internal threads 62. Lower seal member 42 has adjacent to the lower end thereof external threads 68. Support ring 40 is therefore threadably attached to the lower end of seal member 42 prior to the insertion of the seal assembly into the annular area 32. Support ring 40 serves as a bottom structural member for the seal assembly.

The difference between tubing hanger internal diameters D2 and D3 provide a circumferential ledge 70 against which support ring 40 bottoms when the seal is firmly set as illustrated in FIG. 5.

All the sealing functions are accomplished by lower seal member 42 and upper seal member 48. These tubular sealing structures are substantially identical in their construction and their function and appear in the drawings to be in the same element, one extending upwardly the other extending downwardly, however there are some minor differences although if desired the upper and lower seal members could be designed to employ the same element.

Lower seal member 42 is a tubular member having an internal cylindrical surface 72. Downwardly extending from the main body portion of the seal member is an integral circumferential sealing lip 74 that provides a circumferential lower sealing surface 76 dimensioned to compressibly seal against the hanger cylindrical wall surface having the diameter D3 when the seal is fully downwardly positioned. As seen in FIG. 3, in the seal assembly has been placed in the annular area 32 and before sealing engagement of any of the six seals accomplished sealing lip 74 is above hanger external dimension D3 but when in the fully downward position sealing surface 76 firmly engages diameter D3.

Lower seal member 42 has an upwardly extending integral tubular portion that terminates at its upper end with a tubular upper sealing lip 78 having a circumferential upper sealing surface 80. When the seal assembly is fully downwardly positioned circumferential sealing surface 80 seals against hanger external diameter D4.

Lower seal member 42 is further defined by an outer circumferential upwardly extending radially displaceable cup portion 82 that has an outer circumferential sealing lip 84. When the seal assembly is fully downwardly positioned, as shown in FIG. 5 the outer circumferential sealing surface 84 of lower seal member 42 engages well head internal surface 20.

Upper seal member 48 is, as previously indicated, constructed substantially identically to lower seal member 42 and has a lower tubular sealing portion 86 that has a lower circumferential sealing surface 88 that seals against hanger external diameter D5 when the seal assembly is fully set. At the upper end of upper seal 88 is an upper tubular sealing portion 90 having a circumferential sealing surface 92 that engages hanger external diameter D6 when the seal is fully set. Downwardly extending from upper seal 48 is a circumferential cup portion 94 having an outwardly deflectable circumferential sealing lip 98 that engages well head internal cylindrical surface 20 when the seal assembly is fully set.

Circumferential sealing lips 84 and 98 are outwardly forced into sealing engagement with well head internal cylindrical surface 20 by radial expansion produced by tubular actuator 44. Adjacent the upper end of actuator 44 is an inclined frusto-conical surface 100 and, in like manner, adjacent the lower end is a lower frusto-conical surface 102. When seal energizer 52 is fully downwardly threaded as shown in FIG. 5 upper seal member 48 is downwardly displaced relative to lower seal member 42 forcing the tubular actuator incline surfaces 100 and 102 against the internal circumferential surfaces of seals 84 and 98 for expanding the seals outwardly into contact with well head internal cylindrical surface 20 as shown in FIG. 5.

It is important that the seal assembly be fully moved to its lowermost position as shown in FIGS. 4 and 5 before outwardly expanding circumferential seals 84 and 98 to engage the well head internal wall. For this reason it is important that seal members 42 and 48 be held apart from each other until the sealing assembly is moved to its lower position. For this purpose a collapsible spacer ring generally indicated by the numeral 46 is employed. The spacer ring 46 consists of three parts, that is a lower tubular element 104, a telescopic split upper tubular element 106, and pins 108. Elements 104 and 106 are telescopic with respect to each other but are normally held in their expanded positions by means of a plurality (preferably three or more) of shear pins 108 that are radially spaced around the assembly. With shear pins 108 intact, tubular members 104 and 106 hold seal members 42 and 48 spaced apart from each other so that when the assembly is placed in annular area 32 and seal energizer 52 is first downwardly threaded the entire assembly is pushed down so that support ring 40 rests against ledge 70. This is shown in FIG. 4. In the condition of FIG. 4, the seal is positioned in its lowermost position, however outwardly expandable seals 84 and 89 have not as yet been forced into contact with well head cylindrical wall 20. When in the furthermost bottom position further downward displacement of seal energizer 52 causes shear pins 108 to sever as seen in FIG. 5, allowing telescopic elements of 104 and 106 of spacer ring 46 to collapse with respect to each other and thereby permit the upper seal member 48 to be downwardly displaced relative to the lower seal member 42 and cause the inclined surfaces 100 and 102 of tubular actuator 44 to radially outwardly expand circumferential seals 84 and 98. Outwardly expanded circumferential seals 94 and 98 are a set simultaneously, that is, the function of spacer ring 96 is not to stage the setting of the seals but only to maintain spacing between seal members 42 and 48 until the assembly is downwardly positioned and to thereafter allow both outwardly expandable sealing lips 84 and 98 to be set simultaneously by the last downward threadible movement of seal energizer 52.

Three sets of circumferentially spaced apart balls are employed in the assembly the lowermost set being identified by the numeral 110, the middle set by the numeral 112 and the uppermost set by the numeral 114. These sets of balls do not function in the operation of the assembly, that is, they are not directly involved in moving components to cause sealing action but are employed only for the purpose of maintaining the innerrelationship of seal components as they are assembled for insertion into and removal of the seal assembly from annular area 32. After the seal assembly is in position as shown in the drawings the sets of balls 110, 112, 114 do not have a function in the setting of the seal. The balls are inserted through openings (not shown) in alignment with the plane of the balls, at least one opening being formed in lower seal member 42 and at least one for each of the sets 112 and 114 in upper seal member 48.

The assembly for sealing the annulas between concentric cylindric surfaces of this invention is particularly useful when the annulas has communicating with it a test port, such as test port 30 shown in the drawings. The test port extends, as shown in FIG. 1 to the exterior surface of well head 10 where it is normally closed with a small valve (not shown). Test ports are frequently employed in well head structures to test the efficacy of sealing arrangements and to insure that no leakage is occurring past seals. In the present case an improved sealing arrangement is provided in that test port 30, at its inner end where it communicates with well head internal surface 20 communicates between intermediate seals on the hanger external surface provided at diameters D4 and D5. That is, with the seal assembly fully set the lower seal member 42 upper sealing surface 80 circumferentially engages the hanger at diameter D4 and the lower seal 88 of upper sealing member 48 engages the hanger cylindrical surface at diameter D5. This provides a confined, isolated area within the annular space 32 that is communicated with by test port 30. In like manner the test port communicates between sealing lips 84 and 88 that seal against the hanger internal cylindrical surface 20. Thus the seal assembly as illustrated and described herein provides a system wherein the external cylindrical surface of the hanger has two circumferential seals below the test port and two circumferential seals above the test port and the test port communicates between intermediate circumferential sealing surfaces to provide an accurate indication of whether leakage is occurring.

The assembly for sealing the annular area between a tubing hanger and well head as described herein has advantages over other similar types of sealing systems in that it does not require a complex system to stage the setting of seals. All of the seals are metal to metal, that is, there are no elastomeric seals employed thereby the sealing system is immune to resistance against leakage over time and has improved safety in the event of fire.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An assembly for sealing an annular space between the inner cylindrical surface of a wellhead and an outer cylindrical surface of a hanger comprising:

a vertically translatable metallic upper seal member having a circumferential outwardly displaceable upper sealing lip;

a vertically translatable metallic lower seal member having a circumferential outwardly displaceable lower sealing lip;

a tubular actuator positioned between said upper and lower seal members and having an inclined upper end portion configured to radially outwardly displace said upper circumferential sealing lip and an inclined lower end portion configured to radially outwardly displace said lower circumferential sealing lip; and a downwardly displaceable seal energizer for moving said upper seal member towards said lower seal member to cause said actuator to concomitantly radially outwardly expand said upper and lower circumferential sealing lips to seal against the inner cylindrical surface of a wellhead.

2. An assembly for sealing the annular space between concentric outer and inner cylindrical members, the inner cylindrical member having spaced apart circumferential upper and lower sealing surfaces, comprising:

a tubular metallic upper seal member received on the inner cylindrical member and having a radially outwardly deflectable circumferential upper sealing lip and an upwardly facing circumferential inner sealing surface;

a tubular metallic lower seal member received on the inner cylindrical member below said upper seal member and having a radially outwardly deflectable circumferential lower sealing lip and a downwardly facing circumferential inner sealing surface;

a tubular actuator received on the inner cylindrical member between said upper and lower seal members; and an energizer for forcibly downwardly displacing said upper seal member towards said lower seal member to concomittantly radially outwardly deflect said upper and lower circumferential sealing lips against the outer cylindrical member and to move said circumferential inner sealing surfaces of said upper and lower seal members into contact with the upper and lower sealing surfaces of the inner cylindrical member.

3. An assembly for sealing the annual space between a generally vertically oriented tubular member inner cylindrical surface and an inner cylindrical member outer cylindrical surface, the cylindrical member outer cylindrical surface being defined by spaced apart circumferential portions of increased external diameters in the downward direction providing a lower circumferential sealing surface and an upper circumferential sealing surface, comprising:

a tubular metallic upper seal member received on the cylindrical member and having a radially outwardly deflectable circumferential upper sealing lip and a circumferential inner sealing surface;

a tubular metallic lower seal member received on the cylindrical member below said upper seal member and having a radially outwardly deflectable circumferential lower sealing lip and a circumferential inner sealing surface;

a tubular actuator received on the cylindrical member between said upper and lower seal members;

an energizer for forcibly downwardly displacing said seal members to (1) concomittantly radially outwardly deflect said upper and lower circumferential sealing lips against the tubular member inner cylindrical surface, (2) downwardly displace said lower seal member to cause said inner sealing surface thereon to compressibly engage the cylindrical member lower sealing surface and (3) downwardly displace said upper seal member to cause said inner sealing surface thereon to compressibly engage the cylindrical member upper sealing surface.

4. An assembly for sealing an annular space between the inner cylindrical surface of a wellhead and an outer cylindrical surface of a hanger comprising:

a vertically translatable upper seal member having a circumferential outwardly displaceable upper sealing lip;

a vertically translatable lower seal member having a circumferential outwardly displaceable lower sealing lip;

a telescopically collapsible floating spacer ring positioned between said upper and lower seal members;

a tubular actuator positioned between said upper and lower seal members surrounding said spacer ring and having an upper end portion for radially outwardly displacing said upper circumferential sealing lip and a lower end portion for radially outwardly displacing said lower circumferential sealing lip; and a downwardly displaceable seal energizer for moving said upper seal member towards said lower seal member to collapse said spacer ring to thereby allow said actuator to concomitantly radially outwardly expand said upper and lower circumferential sealing lips to seal against the inner cylindrical surface of a wellhead.

5. An assembly for sealing the annular space between a vertically oriented outer tubular member having an internal cylindrical surface and a concentric inner cylindrical member having an external cylindrical surface, the inner cylindrical member external cylindrical surface being defined by spaced apart circumferential portions of increased external diameters in the downward direction providing (a) an upper sealing surface, (b) an intermediate upper sealing surface, (c) an intermediate lower sealing surface and (d) a lower sealing surface and wherein the outer tubular member has a test port extending from an exterior surface to the internal cylindrical surface between the intermediate sealing surfaces (b) and (c), the assembly comprising:

a tubular upper seal member received on the cylindrical member and having a radially outwardly deflectable circumferential sealing lip (e) a downwardly extending circumferential inner seal (f) and an upwardly extending circumferential inner seal (g);

a tubular lower sealing member received on the cylindrical member below said upper seal member having a radially outwardly deflectable circumferential sealing lip (h), a downwardly extending circumferential inner seal (i) and an upwardly extending circumferential inner seal (j);

a tubular actuator received on the cylindrical member between said upper and lower seal members; and an energizer (i) for forcibly downwardly displacing said seal members (1) to cause said actuator to concommittantly radially outwardly deflect said upper and lower circumferential sealing lips (e) and (h) against the tubular member inner cylindrical surface, (2) cause said downwardly extending inner seal (i) to sealably engage the inner cylindrical member lower sealing surface (d) and said upwardly extending inner seal (j) to sealably engage the cylindrical member intermediate lower sealing surface (c) and (3) cause said upwardly extending inner seal (g) to sealable engage the cylindrical member upper sealing surface (a) and said downwardly extending inner seal (f) to sealable engage said cylindrical member intermediate upper sealing surface (b) to seal the annular space while isolating said test port between said intermediate upper and lower sealing surfaces (b) and (c).

6. A wellhead system comprising:

a wellhead having a vertical inner cylindrical surface and a test port extending between the inner surface and an exterior surface;

a hanger having an outer cylindrical surface received concentrically within said wellhead, the outer cylindrical surface having a plurality of vertically spaced apart increased external diameter circumferential sealing surfaces;

an upper and a lower tubular seal members each having adjacent each end thereof a circumferential inner sealing portion having a circumferential sealing surface and an intermediate radially expandable circumferential sealing lip;

a tubular actuator received on said hanger between said upper and lower tubular seals; and an energizer for forcibly downwardly displacing said upper and lower seal members with said actuator therebetween, the actuator being configured to concommittantly radially outwardly expand said circumferential sealing lips of said seal members and each said sealing portion of each of said seal members sealable engaging a said hanger sealing surface, said test port communicating between two adjacent of said sealing surfaces.

* * * * *